United States Patent [19]

Ishida

[11] 4,411,241

[45] Oct. 25, 1983

[54] METHOD OF CONTROLLING EGR FOR INTERNAL COMBUSTION ENGINES

[75] Inventor: Tokuzi Ishida, Hamamatsu, Japan

[73] Assignee: Suzuki Jidosha Kogyo Kabushiki Kaisha, Shizuoka, Japan

[21] Appl. No.: 361,055

[22] Filed: Mar. 23, 1982

[30] Foreign Application Priority Data

Jun. 15, 1981 [JP] Japan ..... 56-90907

[51] Int. Cl.[3] ..... F02M 25/06; F02P 5/00; F02M 33/02

[52] U.S. Cl. ..... 123/568; 123/407; 123/411; 123/518; 123/521; 123/1 R

[58] Field of Search ..... 123/568, 1, 571, 407, 123/411, 518, 520, 521

[56] References Cited

U.S. PATENT DOCUMENTS

| | | | |
|---|---|---|---|
| 3,294,073 | 12/1966 | Bressan | 123/568 |
| 3,762,384 | 10/1973 | Day et al. | 123/568 |
| 3,766,896 | 10/1973 | Buehler et al. | 123/568 |
| 3,786,793 | 1/1974 | Bohls et al. | 123/568 |
| 3,901,202 | 8/1975 | Hollis, Jr. et al. | 123/568 |
| 3,908,618 | 9/1975 | Tange et al. | 123/568 |
| 3,941,105 | 3/1976 | Yagi et al. | 123/568 |

*Primary Examiner*—Wendell E. Burns

*Attorney, Agent, or Firm*—Eugene E. Renz, Jr.

[57] ABSTRACT

An internal combustion engine has a primary intake passage including a primary throttle valve for supplying engine cylingers with an air-fuel mixture under a full range of loads, a secondary intake passage including a secondary throttle valve for supplying the engine cylinders with an air-fuel mixture under high loads, and an exhaust-gas recirculation passage including an exhaust-gas recirculation valve for introducing an exhaust gas into the primary intake passage. Vacuums at the primary and secondary throttle valves are utilized to control the exhaust-gas recirculation valve. A distributor for producing ignition sparks is also controlled by the vacuums at the primary and secondary throttle valves for ignition timing. The engine also includes a first mechanism for retarding ignition sparks and a second mechanism for promoting engine idling. When the exhaust-gas recirculation valve is controlled, the second mechanism is released, immediately thereafter air is introduced from the secondary intake passage into the primary intake passage for air-fuel ratio control therein, and the first mechanism is released. When the secondary intake passage comes into operation, fuel vapor is introduced from a canister into the secondary intake passage.

4 Claims, 1 Drawing Figure

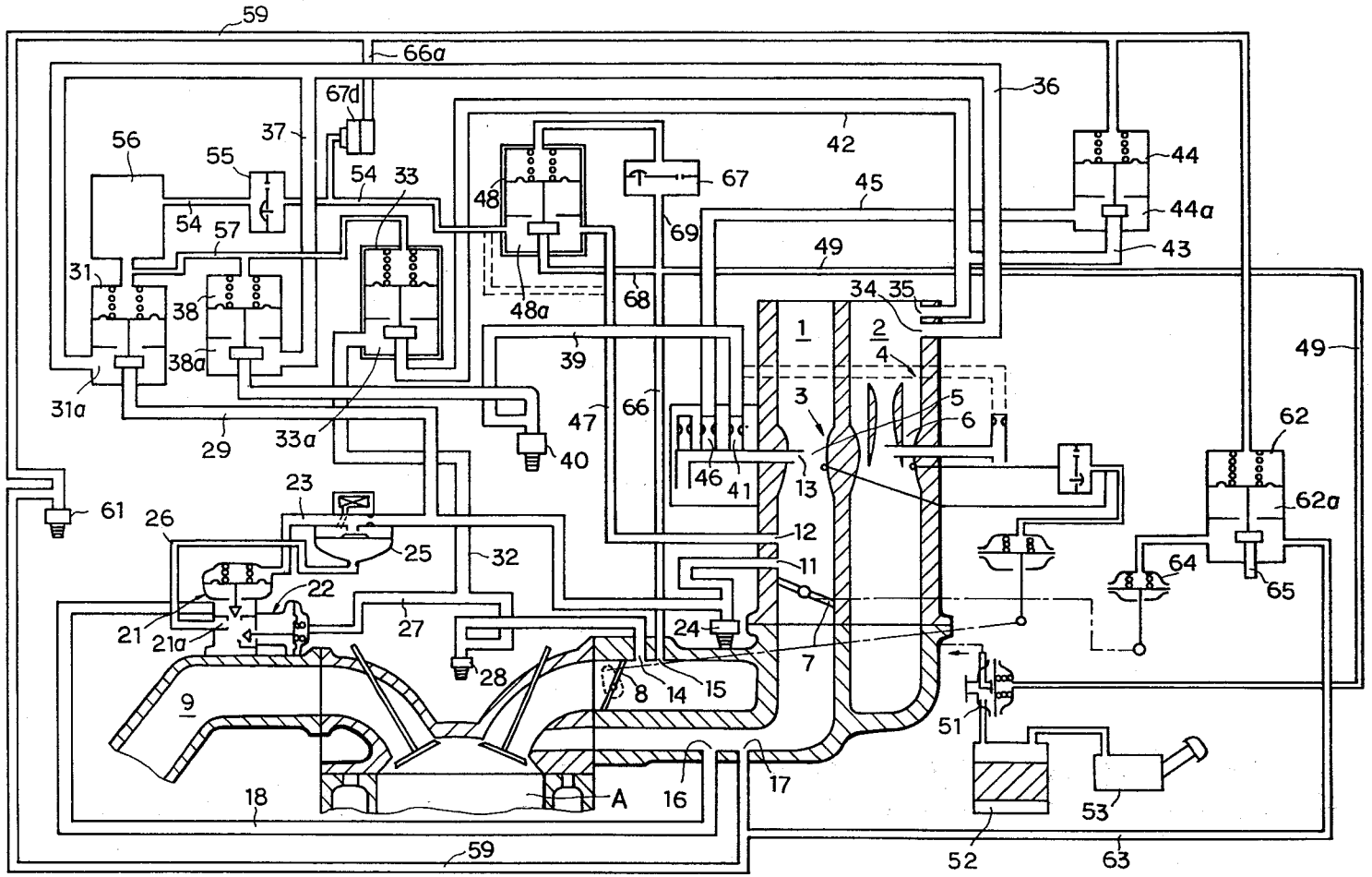
49
62
62a
65
64
44
44a
43
63
53
36
52
51
5
6
35
34
2
4
45
42
49
1
3
13
12
11
7
17
67
41
46
24
15
14
16
69
68
66
8
A
39
47
40
48a
48
32
28
59
66a
33
25
27
54
67d
33a
23
22
37
18
59
55
57
29
38
38a
54
26
21a
9
21
56
61
31
31a

METHOD OF CONTROLLING EGR FOR INTERNAL COMBUSTION ENGINES

BACKGROUND OF THE INVENTION

The present invention relates to a method of controlling exhaust-gas recirculation (EGR) particularly for an internal combustion engine having primary and secondary intake passages.

There have been known internal combustion engines which include a primary intake passage for supplying an air-fuel mixture under a full range of loads and a secondary intake passage for supplying an air-fuel mixture under high loads. The primary intake passage has a diameter that is small enough for it to be able to take care of the practical range of engine operation, and the secondary intake passage has a larger diameter such that it will come into operation only when the engine undergoes acceleration or is otherwise put under a higher load. Such a larger ratio between the cross-sectional areas of the primary and secondary intake passages is selected for more effective functioning of the internal combustion engine with primary and secondary intake passages. With the larger cross-sectional ratios of the primary and secondary passages, however, an EGR valve for the engine cannot be effectively actuated only by a vacuum introduced through a vacuum signal port from the primary intake passage, and hence a sufficient amount of EGR which is proportional to engine loads is not available.

SUMMARY OF THE INVENTION

According to the present invention, an exhaust-gas recirculation valve of an internal combustion engine is controlled by both vacuums at primary and secondary throttle valves, respectively, in primary and secondary intake passages of the internal combustion engine. A distributor for producing ignition sparks is also controlled by the vacuums at the primary and secondary throttle valves for ignition timing. When the EGR valve is controlled a mechanism for promoting engine idling is released, immediately thereafter air is introduced from the secondary intake passage into the primary intake passage for air-fuel ratio control therein, and a mechanism for retarding ignition sparks is released. Fuel vapor is introduced from a fuel-vapor collecting canister into the secondary intake passage when the latter comes into operation.

It is an object of the present invention to provide a method of controlling exhaust-gas recirculation, ignition timing, and air-fuel ratio effectively when an internal combustion engine operates under low and medium loads, without impairing drivability during high-speed and high-load engine operation, for smooth engine operation under low engine loads, reduction in harmful components in the exhaust gas, and an improved thermal efficiency.

The above and other objects, features and advantages of the present invention will become more apparent from the following description when taken in conjunction with the accompanying drawing. in which a preferred embodiment of the invention is shown by way of illustrative example.

BRIEF DESCRIPTION OF THE DRAWING

The sole drawing is a pneumatic circuit diagram of an arrangement for controlling exhaust-gas recirculation for an internal combustion engine.

DESCRIPTION OF THE PREFERRED EMBODIMENT

An internal combustion engine includes a primary intake passage 1 for supplying an air-fuel mixture into an engine cylinder A under a full range of loads, and a secondary intake passage 2 for supplying an air-fuel mixture into the engine cylinder A under high loads. The primary intake passage 1 has a diameter which is small enough for the primary intake passage 1 to be able to deal with the practical range of operation of the internal combustion engine. The secondary intake passage 2 has a diameter which is much larger than that of the primary intake passage 2 such that the secondary intake passage 2 will come into operation when the internal combustion engine operates in modes of acceleration or otherwise is placed under higher loads. The primary and secondary intake passages 1, 2 have primary and secondary carburator barrels 3, 4, respectively, which include primary and secondary venturis 5, 6, respectively. The primary and secondary intake passages 1, 2 also include primary and secondary throttle valves 7, 8, respectively, which will open and close the corresponding intake passages 1, 2 to control supply of an air-fuel mixture into the engine cylinder A. An exhaust gas is dischargeable from the engine cylinder A through an exhaust passage 9. Vacuum signal ports 11, 12 opens into the primary intake passage 1 immediately upstream of the primary throttle valve 7 for picking up a vacuum at the throttle valve 7 on the primary side. A nozzle 13 projects into the primary venturi 5 for supplying air from the secondary intake passage 2 into the primary venturi 5. Vacuum signal ports 14, 15 are disposed so as to open into the secondary intake passage 2 just upstream of the secondary throttle valve 8 to pick up a vacuum at the throttle valve 8 on the secondary side. An exhaust-gas recirculation port 16 opens into the primary intake passage 1 downstream of the primary throttle valve 7 for introducing an exhaust gas controllably into the primary intake passage 1. A manifold vacuum pickup port 17 also opens into the primary intake passage 1 downstream of the primary throttle valve 7 to pick up a vacuum in the primary intake passage 1 downstream of the throttle valve 7.

An exhaust-gas recirculation (EGR) circuit will first be described. An EGR passage 18 extends in communication between the exhaust gas passage 9 and the exhaust-gas recirculation port 16, and includes therein a combined EGR valve assembly which comprises a first EGR valve 21 and a second EGR valve 22 that have a common exhaust gas chamber 21*a*. The first EGR valve 21 is held in communication with the vacuum signal port 11 on the primary side via a passage 23, which has therein a fourth thermosensitive valve 24. The fourth thermosensitive valve 24 is in the form of a bimetal vacuum switching valve, for example, which is actuatable in response to a predetermined temperature of coolant water for the engine. A pressure modulator 25 which comprises an exhaust gas pressure transducer, for example, is disposed in the passage 23 and has an exhaust gas chamber communicating with the common exhaust gas chamber 21*a*. The second EGR valve 22 communicates with the secondary vacuum signal port 14 through a passage 27 which is openable and closable by a first thermosensitive valve 28 disposed therein. The passage 23 has a bypass passage 29 which opens into a chamber 31*a* in a first vacuum-controlled valve 31. The passage 27 also has a bypass passage 32 opening into a chamber 33*a* in a third vacuum-controlled valve 33. Thus, the EGR valve assembly can be controlled by vacuums in the primary and secondary intake passages 1, 2 for desired precise EGR control.

A circuit system for introducing air from the secondary intake passage 2 into the primary intake passage 1 will now be described. A pair of first and second air supply ports 34, 35 open into the secondary intake passage 2 immediately upstream of the secondary carburetor barrel 4. The first air supply port 34 is held in communication with the chamber 31*a* in the first vacuum-controlled valve 31 through an air passage 36. The air passage 37 has a branch passage 37 which communicates with a chamber 38*a* in a second vacuum-controlled valve 38. The chamber 38*a* communicates with the nozzle 13 via an air supply passage 39 having a second thermosensitive valve 40 and a first air jet 41. The second air supply port 35 communicates through an air supply passage 42 with the chamber 33*a* in the third vacuum-controlled valve 33, and has a branch passage 43 which is in communication with a chamber 44*a* in a fifth vacuum-controlled valve 44. The chamber 44*a* communicates via an air supply passage 45 having a second air jet 46 with the nozzle 13.

The vacuum signal port 12 on the primary side communicates via a passage 47 with a chamber 48*a* in a fourth vacuum-controlled valve 48. The chamber 48*a* is held in communication with a vacuum chamber in a control valve 51 through a passage 49. The control valve 51 communicates with a canister 52 for collecting fuel vapor from engine parts such as carburetor float chambers, a gasoline tank 53 and the like. The control valve 51 is also in communication with the secondary intake passage 2 for controlled supply of fuel vapor from the canister 52 into the secondary intake passage 2. The chamber 48*a* in the fourth vacuum-controlled valve 48 communicates via a passage 54 having a second vacuum delay valve 55 such as a vacuum transmitting valve with an accumulator 56 which communicates with a vacuum chamber in the first vacuum-controlled valve 31. The accumulator 56 is also held in communication via a passage 57 with vacuum chambers in the second and third vacuum-controlled valves 38, 33. The vacuum signal port 15 on the secondary side communicates with a vacuum chamber in the fourth vacuum-controlled valve 48 through a passage 66 having a first vacuum delay valve 67.

The manifold vacuum pickup port 17 is in communication through a passage 59 having a third thermosensitive valve 61 with vacuum chambers in the fifth vacuum-controlled valve 44 and a sixth vacuum-controlled valve 62. The sixth vaccum-controlled valve 62 has a chamber 62*a* which communicates with the manifold vacuum pickup port 17 via a passage 63 and with an actuator 64. The chamber 62*a* is controllably vented to the atmosphere via a vent passage 64. The actuator 64 is interlinked with the primary throttle valve 7 and serves as a mechanism for promoting engine idling operation during a predetermined period of time. The passage 59 has a branch passage 66*a* which is connected to a distributor 67*d* for controlling ignition timing.

Operation of the illustrated arrangement for engine control including EGR control will be described.

Until the engine cooling water reaches a predetermined temperature after the engine has been started, the engine remains relatively cold. During this time, no EGR takes place. More specifically, the fourth and first thermosensitive valves 24, 28 remain closed until the predetermined coolant water is reached, and hence keep the vacuum passages 23, 27 closed. The first and second EGR valves 21, 22 thus remain inactivated. During the cold period of time, no air is introduced from the secondary intake passage 2 into the primary intake passage 1. More specifically, the second thermosensitive valve 40 maintaines the air supply passage 39 closed until the predetermined coolant temperature is reached. Since the third thermosensitive valve 61 also remains closed, the fifth vacuum-controlled valve 44 is prevented from being actuated. Therefore, the air-fuel ratio of an air-fuel mixture supplied through the primary intake passage 1 into the engine cylinder A is maintained on the rich side while the engine stays relatively cold, resulting in a stable fast idle mode of operation. At the time of starting the engine, choking is effected on the engine. However, the choke valve will be shifted to the lean side when the engine gets started.

Until the temperature of the coolant water reaches a predetermined level, the sixth vacuum-controlled valve 62 remains inactivated, allowing a manifold vacuum to be transmitted via the manifold vacuum signal port 17 and the passage 63 to the actuator 64, which keeps the primary throttle valve 7 open to a predetermined extent. This forced opening of the primary throttle valve 7 prevents the engine from being stopped due to accidental full opening of the choke valve while the engine stays comparatively cold.

With the third thermosensitive valve 61 closed, the manifold vacuum is not transmitted from the primary intake passage 1 to the distributor 67*d*, which thus keeps retarding ignition sparks for accelerated engine warming operation.

The foregoing mode of operation allows the engine to be less choked and also to be supplied with a minimum required amount of enriched air-fuel mixture while the engine is relatively cold. During this time, the engine operates stably, ignition plugs do not get wet with fuel, and pollutants in the exhaust gas are reduced.

When the engine becomes relatively warm while in operation, the third thermosensitive valve 61 is opened to permit a vacuum from the primary manifold to act via the passage 59 on the fifth vacuum-controlled valve 44, which now allows communication between the air supply port 35 and the air jet 46 through a predetermined cross-sectional passage area. Then, air is introduced from the secondary intake passage 2 into the primary venturi 5 through the nozzle 13 to correct the air-fuel ratio of the air-fuel mixture flowing through the primary intake passage 1 to a desired level. At the same time, the vacuum from the primary manifold acts via the passage 59 in the vacuum chamber in the sixth vacuum-controlled valve 62. The chamber 62*a* and hence a vacuum chamber in the actuator 64 are now vented to the atmosphere, whereupon the actuator 64 is inactivated. The primary throttle valve 7 then returns from the wider open position to a normal idling position. Upon opening of the third thermosensitive valve 61, the setting of the distributor 67*d* is adjusted from late ignition timing to normal ignition timing.

When the engine is sufficiently warmed, and while the engine operates under a normal range of loads, a vacuum in the primary intake passage 1 is delivered via the vacuum signal port 11 and the passage 23 to the pressure modulator 25, in which the vacuum is vacuum-modulated by the exhaust gas, and acts on the first EGR valve 21 for effecting exhaust-gas recirculation at a rate determined by the first EGR valve 21. When the engine is placed under a higher load such as for acceleration, the secondary intake passage 2 comes into operation, causing a vacuum in the secondary intake passage 2 to be transmitted via the vacuum signal port 14 and the passage 27 to the second EGR valve 22 for carrying out added exhaust-gas recirculation.

In a mode in which EGR is to be stopped, a vacuum in the primary intake passage 1 is delivered through the vacuum signal port 12, the passage 47, the chamber 48*a* in the fourth vacuum-controlled valve 48, the second vacuum delay valve 55, and the accumulator 56 in which the transmitted vacuum undergoes a given time delay, to the vacuum chamber in the first vacuum-controlled valve 31. The first vacuum-controlled valve 31 is now actuated to permit communication between the air supply passage 36 and the bypass passage 29, whereupon the atmospheric pressure acts on the first EGR valve 21, which is then closed. Likewise, the third vacuum-controlled valve 33 is actuated to apply the atmospheric pressure to the second EGR valve 22, which is then closed. At this time, air is introduced from the secondary intake passage 2 into the primary intake passage 1 to prevent the air-fuel mixture in the primary intake passage 1 from becoming too rich. More specifically, the second vacuum-controlled valve 38 is also actuated by the vacuum transmitted from the primary intake passage 1 to enable communication between the passage 37 and the passage 39, whereupon air from the secondary intake passage 2 is supplied through the air jet 41 and the nozzle 13 into the primary intake passage 1 to render the air-fuel mixture therein leaner.

As the secondary throttle valve 8 opens wider, a vacuum in the secondary intake passage 2 is transmitted via the vacuum signal port 15, the passage 66, the passage 69, and the first vacuum delay valve 67 to the fourth vacuum-controlled valve 48. The fourth vacuum-controlled valve 48 is actuated by the vacuum acting in its vacuum chamber to open the passage 68. The vacuum from the secondary intake passage 2 is now delivered from the passage 68 to the passage 54, whereupon the first and second EGR valve 21, 22 are closed in the manner described below.

Fuel vapor from the gasoline tank 53, the carburetor float chamber, and the like is temporarily stored in the canister 52 and will be supplied into the secondary intake passage 2 when the secondary intake passage 2 comes into operation and the control valve 51 is opened by the vacuum developed in the secondary intake passage 2.

With the foregoing arrangement, the amount and timing of supply of EGR and air from the secondary intake passage 2, ignition timing, and supply of vapor fuel into the secondary intake passage 2, are all controlled by coaction and switching between vacuums developed in the primary and secondary intake passages 1, 2.

The method of controlling EGR according to the present invention has the following advantages:

(1) Precise EGR control is rendered possible which suits the operation of an internal combustion engine with a duplex carburetor using a lean air-fuel mixture, resulting in smooth engine performance.

(2) The engine can reach a stable fast idle mode, get warm rapidly, and enter a normal mode of operation quickly from a cold start.

(3) Accurate control can be effected for the idling promotion mechanism and air-fuel ratio correction, with the results that engine rotation while the engine is comparatively warm is stable, and the spark plugs are prevented from getting wet with fuel.

(4) Supply of vapor fuel collected from various engine parts into the secondary intake passage makes the engine less susceptible to variations in the air-fuel ratio, resulting in better drivability.

Therefore, engine performance in the high-speed and high-load range will not be impaired, the engine will operate smoothly under low loads, harmfull exhaust components will be reduced, and the thermal efficiency of the engine will be improved, while the engine with primary and secondary intake passages operates when supplied with a lean air-fuel mixture or a less combustible air-fuel mixture resulting from EGR.

Although a certain preferred embodiment has been shown and described in detail, it should be understood that various changes and modifications may be made therein without departing from the scope of the appended claims.

What is claimed is:

1. A method of controlling exhaust-gas recirculation for an internal combustion engine having a primary intake passage for supplying an air-fuel mixture under a full range of loads, a secondary intake passage for supplying an air-fuel mixture under high loads, and an exhaust-gas recirculation passage having an exhaust-gas recirculation valve for introducing an exhaust gas into said primary intake passage, said method comprising the step of utilizing a vacuum at a primary throttle valve in said primary intake passage and a vacuum at a secondary throttle valve in said secondary intake passage to control said exhaust-gas recirculation valve.

2. A method of controlling exhaust-gas recirculation for an internal combustion engine having a primary intake passage for supplying an air-fuel mixture under a full range of loads, a secondary intake passage for supplying an air-fuel mixture under high loads, an exhaust-gas recirculation passage having an exhaust-gas recirculation valve for introducing an exhaust gas into said primary intake passage, and a distributor for producing ignition sparks, said method comprising the step of utilizing a vacuum at a primary throttle valve in said primary intake passage and a vacuum at a secondary throttle valve in said secondary intake passage to control said exhaust-gas recirculation valve and said distributor for ignition timing.

3. A method of controlling exhaust-gas recirculation for an internal combustion engine having a primary intake passage for supplying an air-fuel mixture under a full range of loads, a secondary intake passage for supplying an air-fuel mixture under high loads, an exhaust-gas recirculation passage having an exhaust-gas recirculation valve for introducing an exhaust gas into said primary intake passage, a first mechanism for retarding ignition sparks, and a second mechanism for promoting engine idling, said method comprising the steps of utilizing a vacuum at a primary throttle valve in said primary intake passage and a vacuum at a secondary throttle valve in said secondary intake passage to control said exhaust-gas recirculation valve, releasing said secondary mechanism, immediately thereafter introducing air from said secondary intake passage into said primary intake passage for air-fuel ratio control therein, and releasing said first mechanism.

4. A method of controlling exhaust-gas recirculation for an internal combustion engine having a primary intake passage for supplying an air-fuel mixture under a full range of loads, a secondary intake passage for supplying an air-fuel mixture under high loads, an exhaust-gas recirculation passage having an exhaust-gas recirculation valve for introducing an exhaust gas into said primary intake passage, and a canister for collecting fuel vapor from engine parts, said method comprising the steps of utilizing a vacuum at a primary throttle valve in said primary intake passage and a vacuum at a secondary throttle valve in said secondary passage to control said exhaust-gas recirculation valve, and introducing fuel vapor from said canister into said secondary intake passage when the latter comes into operation.

* * * * *